United States Patent [19]

Baum

[11] 4,064,815

[45] Dec. 27, 1977

[54] TABLE LEG LOCKING MECHANISM

[75] Inventor: Elliott W. Baum, St. Louis, Mo.

[73] Assignee: Berco Industries, St. Louis, Mo.

[21] Appl. No.: 706,737

[22] Filed: July 19, 1976

[51] Int. Cl.[2] ..... A47B 3/08

[52] U.S. Cl. ..... 108/129; 108/132; 248/188.6

[58] Field of Search ..... 108/132, 131, 129; 403/66; 248/188.6; 297/408

[56] References Cited

U.S. PATENT DOCUMENTS

| | | | |
|---|---|---|---|
| 210,156 | 11/1878 | Schultes et al. | 248/188.6 X |
| 1,921,825 | 1/1960 | Spiegel | 108/132 X |
| 2,572,474 | 10/1951 | Hamilton | 108/132 |
| 2,697,018 | 12/1954 | Georgides | 108/131 X |
| 3,013,850 | 12/1961 | Pieschel | 108/131 |
| 3,491,706 | 1/1970 | Glass | 248/188.6 |
| 3,547,486 | 12/1970 | Herzer | 297/408 |

*Primary Examiner*—Francis K. Zugel
*Attorney, Agent, or Firm*—Paul M. Denk

[57] ABSTRACT

A table leg locking mechanism that secures the legs of a table into operative position when a retaining member of the locking mechanism is engaged, with said retaining member normally being biased into this engaging disposition through the agency of a spring; the locking mechanism includes a cross bar that secures to the table leg(s), a pair of housings having the cross bar pivotally mounted therethrough, with one of said housings incorporating a pair of sleeves, one of the sleeves being rigidly secured internally to the housing, and the other sleeve being rigidly fixed to the cross bar. The retaining member includes a wedging member(s) projecting from one of the sleeves, with a complementary groove(s) provided in the other sleeve, whereby the pivoting of the leg into its operative position allows the wedging member to become wedged within the groove for fixing the table leg into a supportive position.

5 Claims, 5 Drawing Figures

TABLE LEG LOCKING MECHANISM

BACKGROUND OF THE INVENTION

This invention relates generally to table construction, but more particularly, pertains to a table leg locking mechanism that may secure the table leg(s) into its supportive position.

Numerous styles of locking mechanisms or securing devices for table legs are provided in the prior art. For example, and the most customary form of locking mechanism includes an eccentric form of spring mount that urges the table legs into an operative position, once the legs have been pivoted past the midpoint towards that position. Such a mechanism is commonly displayed in those prior art patents that cover the standard form of card table that is readily available upon the market.

Other styles of prior art locking mechanisms, that are frequently used for the card table style of securement, includes a sleeve like coupling that is mounted concentrically upon the table leg, and when pulled downwardly against the bias of the spring, as when the adjustable leg approaches its erective position, the sleeve may then be released for securement upon a fixed tab that extends from the underside of a table, thereby locking the table leg into place. These earlier types of table securements are satisfactory for their intended purpose, and that is to provide a readily portable table that may be easily erected, or collapsed, so as to allow for its prompt usage or storage, respectively.

The current invention pertains more particularly to a more sturdy type of table, usually of some length, of the type that is frequently used for business purposes, such as for use in offices, or at conventions, and therefore, by necessity, must be constructed of a more sturdy design so as to provide full rigidity when erected into an operative position. Prior art tables designed for this type of usage normally include a table leg that pivotally mounts to the underside of a table, and then also includes a linked bracing that may be snapped into a fastening position thereby securing the legs into their elected disposition. Once again, tables constructed of this configuration have been satisfactory for their intended purpose, but, in addition, they usually are quite wobbly to the touch, and are normally recognized as being available only for their intended purpose, and that is for a temporary usage.

The current invention is designed to provide a table construction that includes a locking mechanism that quite satisfactorily stably supports and engages the legs of a table to its table surface, eliminating any semblance of looseness or instability for the erected table, but more particularly, firmly engages the locking of the table legs into a supportive position, thereby preventing any collapse of the table as frequently occurs during usage of the prior art type of devices.

It is, therefore, the principal object of this invention to provide a locking mechanism for securing table legs to a table surface in a manner that eliminates all instability in the support of the table when set up.

Another object of this invention is to provide a locking mechanism that may be associated with one or more legs of a table and provide for and insure the rigid positioning of each leg with respect to the supported table surface.

Another object of this invention is to provide a locking mechanism for a table leg assembly which when engaged into an operative position obviates any chance for collapse of the assembled table regardless of its rough handling.

Yet another object of this invention is to provide a locking mechanism for a table leg assembly that can dispose and engage the table legs into either their erect or operative position, or into a nonoperative and effectively concealed location.

A further object of this invention is to provide a locking mechanism for a table leg assembly that can be totally fabricated independent of the table construction, and then assembled and secured to the table surface as a final step in its assembly.

These and other objects will become more apparent to those skilled in the art upon reviewing the summary of this invention, and while considering the description of the preferred embodiment in view of its drawings.

SUMMARY OF THE INVENTION

This invention contemplates a support for a table comprising a leg locking mechanism that insures the rigid fixation of the various table legs in place when they have been positioned into an upright configuration for supporting the table erect. It envisions the use of one such locking mechanism for each leg of the table, or perhaps for each pair of legs of the table that are aligned for use in supporting an end of the table. The locking mechanism, by necessity, is used in conjunction with a table having foldable legs, and which legs can be pivoted either to their nonoperative position, folding flush against the underside of the table surface, or turned into a downward depending position whereby they stably support the table upon the ground.

The locking mechanism includes a pivot mount, structured more in the shape of a rectangular housing, there being a pair of these mounts provided to either side of the table leg, or perhaps a pair of said mounts between a pair of table legs that are arranged proximate the sides of the table. In any event, one of the pivot mounts will provide a form of pivot block that pivotally mounts a cross bar that is rigidly and integrally secured to one or more table legs, with the other pivot mount also including means for pivotally mounting of the cross bar, at its other approximate end, but in addition, incorporates internally of its housing the retainer means or locking mechanism that make this table structure more stable in its function.

The locking mechanism includes a pair of sleeves that are concentrically mounted upon the cross bar, within the housing, with one of said sleeves being welded or otherwise secured to an internal side of the housing, with the other sleeve being rigidly secured to the cross bar itself. A spring normally biases against the sleeve that is secured with the cross bar, thereby urging said sleeve, its cross bar, in addition to the secured table leg, always towards a lateral direction so as to achieve a constant pressure contact between the two said sleeves. In addition, one of the sleeves includes a projecting member that is shaped in the form of a wedge, with the other sleeve having a formed groove or slot that is complemental in size and can snugly receive the aforesaid projecting wedge. Furthermore, when the table leg is pivoted into its upright supportive position, the wedging member of one sleeve will insert within the groove of the other sleeve, and with the bias of the spring constantly urging these two sleeves together, the table leg will become firmly fixed in position, and capable of thoroughly supporting the table thereupon. By simply urging the table leg in an opposite lateral direction the wedging member will become disengaged from within the grooved sleeve, thereby allowing the leg once again to be pivoted approximately a quarter turn, more or less, into its nonoperative position against the underside of the table surface, thereby collapsing the table for ready transit or storage.

In view of the foregoing, it is just as likely that another groove may be provided at approximately a quarter turn or 90° from the first formed sleeve groove, so that when a table leg is adjusted into its nonoperative position, the wedging member may insert within this second groove, to thereby lock the leg into its nonoperative position, and not allow it to become unfolded as when the table is being carried to a storage location.

DESCRIPTION OF THE PREFERRED EMBODIMENT

Figure 1:
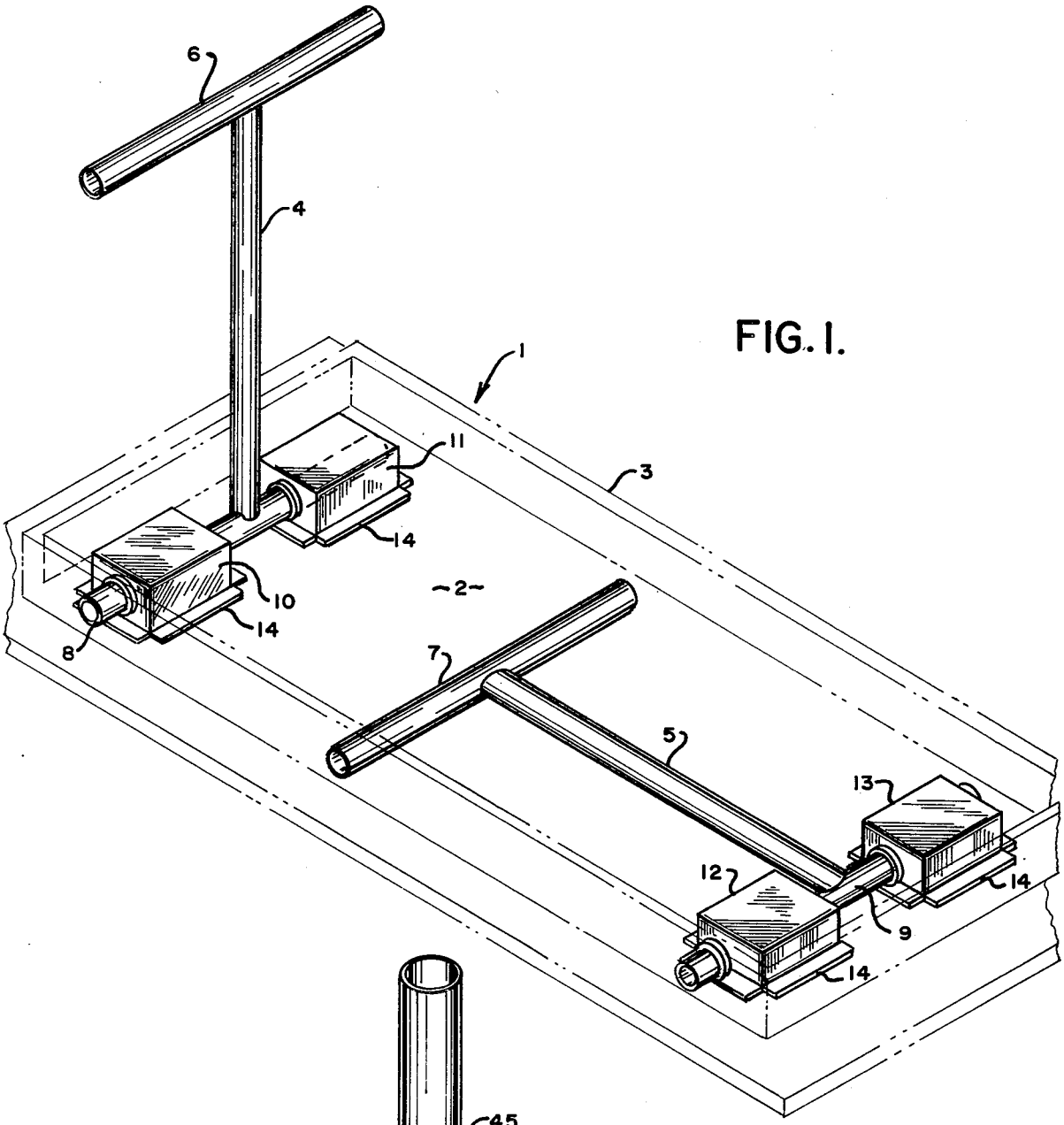
FIG. 1 provides a perspective inverted view of the table of this invention, showing the locking mechanism associated with each leg of the table; one of the legs being arranged in an operative position; with the other leg being disposed in a nonoperative position against the undersurface of the table.

In referring to FIG. 1, there is disclosed a table construction 1 in the style of this invention, wherein the undersurface 2 includes an apron 3 provided in proximity with its periphery, and having sufficient depth so as to conceal the various locking mechanisms associated with this invention.

Also disclosed are a pair of legs 4 and 5, each leg having a base member 6 and 7 that furnishes stable support for the table when resting upon the floor or ground. Provided at the opposite normally upward end of the legs 4 and 5 are cross bars 8 and 9, respectively, each bar extending laterally of the table surface and being pivotally secured within the mounts 10 through 13. Each mount includes a series of flanged portions, as at 14, so that they may be rigidly secured, as by means of screws, or other form of fastening means, to the underside of the table.

Figure 3:
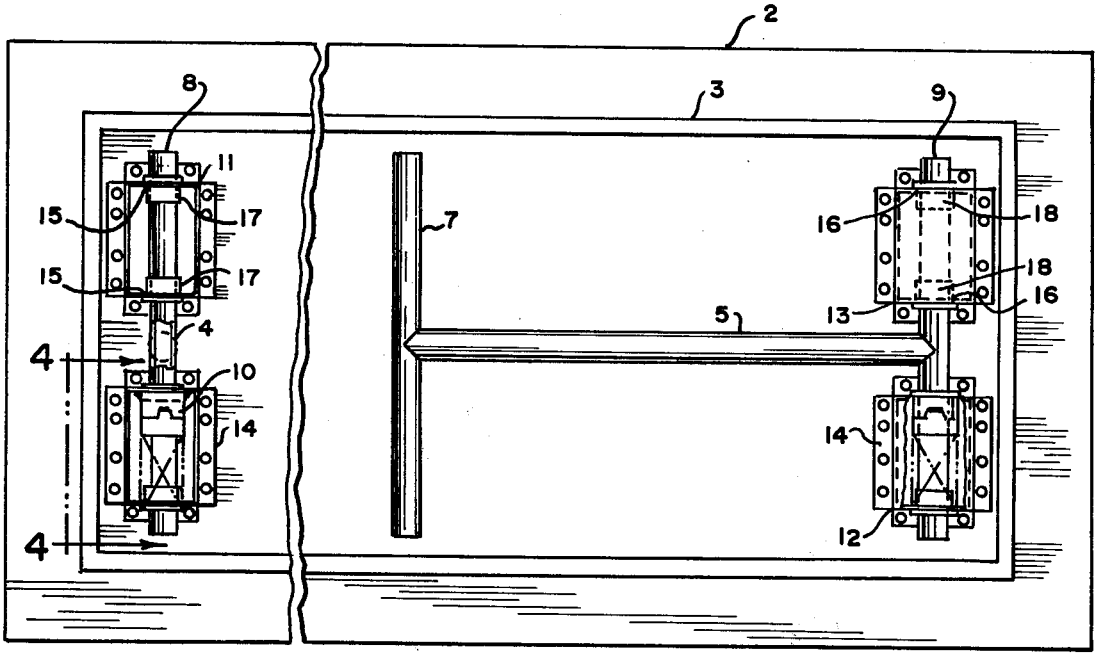
FIG. 3 provides an underside plan view of the invention as shown in FIG. 1.
Figure 4:
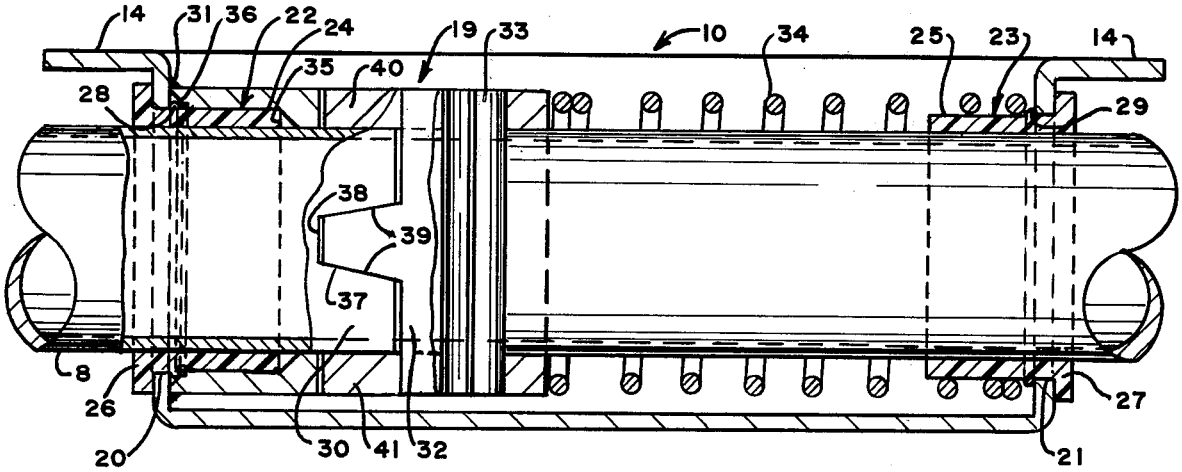
FIG. 4 provides a transverse sectional view of one of the locking mechanisms taken along the line 4—4 of FIG. 3.

By referring to FIGS. 3 and 4, the style of pivot mounts that support the table legs in their movement are more accurately shown. It has been determined that only one locking mechanism is required for each table leg, but, it is desirable for the purpose of providing stable pivotal motion to each leg that a secondary pivot mount also be furnished. This can be seen in FIG. 3 wherein the pivot mounts 11 and 13, arranged to one side of their respective cross bars 8 and 9, do not incorporate any locking mechanisms, but rather, simply furnish pivotal support to their respective cross bars and table legs. Each of the pivot mounts 11 and 13 have a pair of aligned apertures, as at 15 and 16, provided therethrough, and disposed within each aperture is a bushing, as at 17 and 18, so as to facilitate the pivot of their cross bar therein.

Each of these bushings function as slide bearings for their respective cross bars, and are designed to furnish a smooth pivot to their respective legs without causing any damage in the nature of wear, to the same. These bushings may be formed of any type of resistant polymer, such as a plastic, or even a durable nylon, that have a high durometer value so as to prevent wear when functioning in the capacity as a bearing.

To the other side of each table leg is a similar type of pivot mount, namely the pivot mounts 10 and 12, with each of them having the configuration as shown also in FIG. 4. Each of the pivot mounts 10 and 12, and for that matter the previously described and analyzed mounts 11 and 13, are formed in the shape of a rectangular housing, having the flanges 14 bent perpendicularly from their upward edges. These housings include the locking mechanisms 19 of this invention therein as will be subsequently described. Each housing is furnished with an aperture 20 and 21 that are aligned at opposite sides of the same, and into each aperture is pressure fitted a bushing 22 and 23, similar to the bushings 17 and 18 as previously defined. Each bushing includes an integral sleeve like member 24 and 25, that is arranged concentrically with the cross bar 8, with respect to the left end table leg, as shown, and the cross bar 9 has a similar relationship with respect to the bearing mount 12. Each bushing further includes the flanges 26 and 27 that are arranged exteriorly of the housing 10, while the nipples 28 and 29 provide for a snap fastening of the bushings in place with respect to the mount or its formed housing 10.

Also concentrically located upon the cross bar 8 is the retainer means of the locking mechanism, and this includes a first sleeve 30, which is rigidly secured to one interior wall of the housing 10, as by means of a weld, as at 31, or other form of fastening. Further concentrically mounted upon the cross bar 8 is a second sleeve 32, which is rigidly secured to said cross bar by means of a roll pin 33, or other form of fastening. A spring 34 biases against the backside of the sleeve 32, thereby normally urging said against the first sleeve 30, and likewise, always urging the cross bar 8 towards the left, as viewed in FIG. 4. The opposite end of the spring 34, as can be seen, biases against the opposite interior wall of the housing 10.

The sleeve 30 is provided with a counterbore 35 so as to provide clearance for the sleeve like member 24, and in addition, it also includes a chamfer 36 that furnishes additional clearance for the nipple 28 of the bushing 22. Similar structure can be found in the bushing 23.

Figure 2:
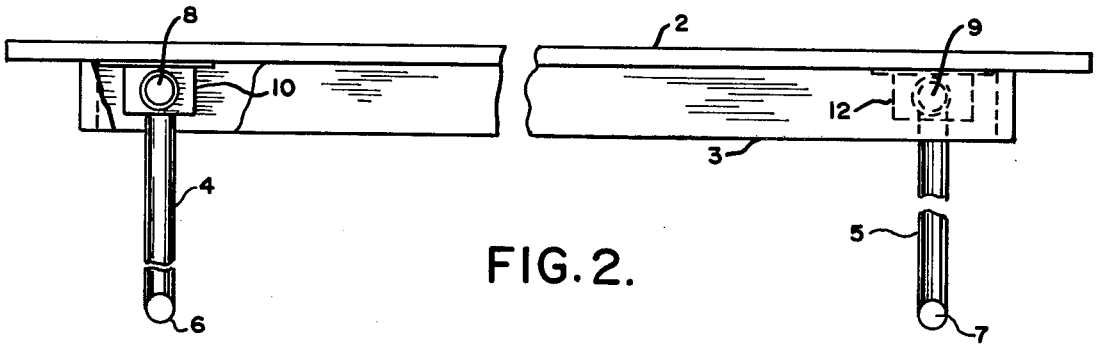
FIG. 2 provides a side view of the invention with both table legs being erected into a supportive position.

Provided extending from one side of the sleeve 32 is a wedge like member 37, which is designed for insertion within a groove or slot 38 formed within the adjacent sleeve 30. The sides 39 of both the wedging member 37 and its complementary groove 38 are tapered or beveled, as shown, so as to provide a snug seating of the member 37 within said groove. Also, when these two sleeves are locked together into the position as shown as just previously described, the leg 4 of the table will be extended in a downwardly depending and supportive position, as shown in FIG. 2. Thus, the leg 4 when fixed in this position is firmly locked in place through the agency of these cooperating sleeves 30 and 32, and more particularly their wedging member and cooperating groove. Although only one wedging member and groove is described with respect to these cooperating sleeves, it is just as likely that more than one wedging member and groove may be provided around the periphery of the said sleeves, so as to insure a rigid locking together of these two members as when the leg 4 is erected into its supportive position. As can be seen in the details of FIG. 4, it would appear that four such wedging members, including the wedging member 37, in addition to the two other shown wedging members 40 and 41, in addition to a wedging member hidden behind the member 37, are provided in the cooperating sleeves of this preferred embodiment. Although, it is just as likely that a single wedging member and cooperating groove could function satisfactorily for the purposes of this invention.

Figure 5:
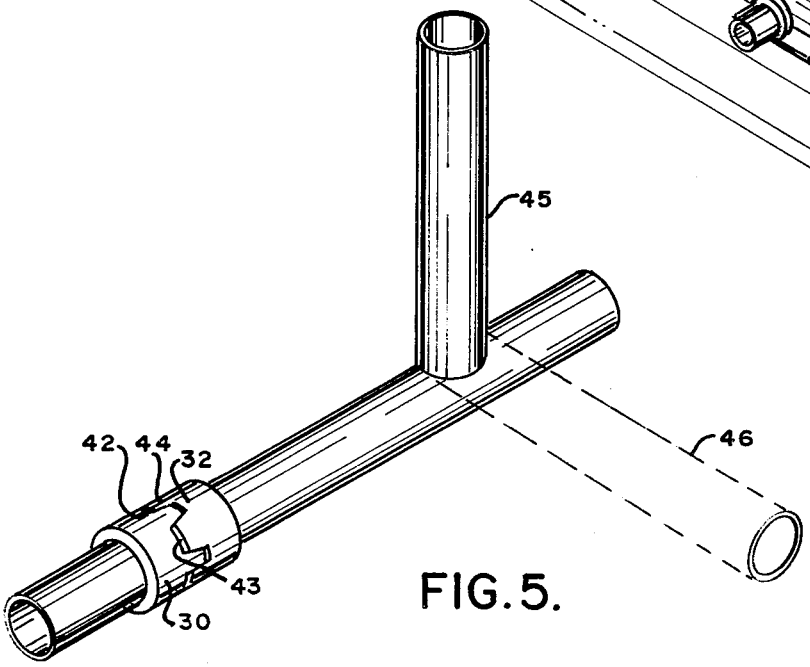
FIG. 5 provides a schematic perspective view of a slightly modified locking mechanism that allows a table leg to be locked also in a nonoperative position, in addition to its operative position.

In the event that only a single wedging member is provided within the sleeve 32, as shown in FIG. 5, it may be desirable to provide a pair of complementary slots or grooves 42 and 43 within the sleeve member 30. Thus, when the wedging member 44 is maintained within the groove 42, the table leg 45 will be maintained upright, so that when a table is erected it will provide support for the same. But, when the leg is folded in a lateral direction so that the wedging member 44 becomes disengaged from within the slot 42, and the leg is then pivoted approximately ninety degrees, it will become wedged with the second groove 43, so as to lock the leg in a nonoperative position as shown in the hidden line at 46. Thus, both a locking means for the operative position of the leg 45, and a locking means for the nonoperative position of the leg, as at 46, could be provided in a modified form of locking mechanism, as shown in this FIG. 5.

It is also just as likely that the groove 43 provided within the sleeve 30 may simply provide a shallow tapered depression within the edge of the sleeve, so that the wedging member 44 may be urged into this depression so as to provide a seating relationship that holds the table leg in its nonoperative position as when the table is collapsed. Then, rather than requiring a full force pull along the leg 46 as when it is desired to erect the table, all one need simply do is pivot the leg 46 from its nonoperative position out of the shallow depression until said leg reaches the position as shown for the table leg 45, at which time its wedging member 44 becomes once again engaged within the slot 42.

In the usage of the table of this invention, all that is required to unfold the table into its operative position is to simply gently pull either table leg towards the pivot mounts 11 or 13, to disengage the retainer means, and then pivot the leg upwardly into an operative position until the wedging member 37 of each locking mechanism becomes disposed within the groove 38. This will rigidly lock the leg into its supportive position. Then, when it is required to collapse the table, all that is demanded is a lateral pull of the leg against the bias of the spring 34 to achieve a disengagement of said wedging member and its slot, to thereby allow the leg to be pivoted approximately ninety degrees into the nonoperative position, such as that position undertaken by the table leg 5 as shown in FIGS. 1 and 3.

It should also be commented that the table legs of this invention may be constructed or a solid metal stock, preferably one that is of polished steel tubing so as to provide a pleasing appearance to these supportive components for the table surface 2, and likewise, provide a heavy base for rigidly stabilizing the table in place when erected upon the floor.

Various modifications to the various components of this invention may occur to those skilled in the art upon reviewing the description of this preferred embodiment. Such modifications, if within the spirit and scope of this invention, and encompassed by the claims appended hereto, are intended to be covered by any patent issuing hereon. The description of the preferred embodiment is set forth for illustrative purposes only, and is not meant to be limiting of the scope of this invention.

Having thus described the invention what is claimed and desired to be secured by Letters Patent is:

1. A table leg locking mechanism for use in fixing a leg with respect to the table means it supports comprising, a cross bar rigidly secured to the table leg, at least one pivot mount secured to said table means and having the cross bar pivotally disposed therethrough, each pivot mount comprising a pair of box shaped housings secured to the underside of the table means, each housing having a pair of aligned apertures provided therethrough, a bushing means being retained proximate each aperture of the housing, said cross bar being bearingly disposed within each bushing means through the housing apertures with said table leg between said housing, retaining means provided within at least one of said housings and provided for fixing its associated table leg into a predetermined position, said retaining means comprising a pair of sleeves, each of said sleeves having the cross bar disposed therethrough, the first sleeve being rigidly secured to one of said housings and proximate the bushing means, the second sleeve being rigidly secured to the cross bar, engaging means cooperating between the said sleeves and capable of fixing the table leg into a supportive position, said engaging means including a wedging member projecting from one of said sleeves, the mating groove being accommodating of the wedging member for engagement of the said sleeves and fixing of the table leg into its supportive position, a spring surrounding said cross bar and operatively associated with the said sleeves, and said spring normally biasing the wedging member of one sleeve into the groove of the other sleeve and thereby fixing the said leg into its operative supportive position.

2. The invention of claim 1 and including a pair of grooves provided in the other sleeve, the first groove of the pair being arranged approximately a quarter turn from the said second groove, and said wedging member capable of disposition within said second groove, and thereby fixing the table leg into a nonoperative position.

3. The invention of claim 2 wherein said wedging member is beveled on at least one side, the grooves also being beveled on at least one of the sides that mates with the beveled side of the wedging member, whereby the beveled sides of the wedging member and the mating grooves fix the table leg into predetermined positions.

4. The invention of claim 3 wherein said bushing means are pressure fitted into their respective housing apertures.

5. The invention of claim 4 wherein there are a series of legs pivotally mounted to the table, and a locking mechanism being operatively associated with each of said legs and capable of securing each leg into a predetermined supportive position.

* * * * *

UNITED STATES PATENT AND TRADEMARK OFFICE

CERTIFICATE OF CORRECTION

PATENT NO. : 4,064,815
DATED : December 27, 1977
INVENTOR(S) : Elliott W. Baum

It is certified that error appears in the above-identified patent and that said Letters Patent are hereby corrected as shown below:

Claim 1, line 12, change "housing" second occurrence to -- housings --.

Claim 4, line 1, change "3" to --- 1 ---.

Claim 5, line 1, change "4" to --- 2 ---.

Signed and Sealed this

[SEAL]

*Eleventh* Day of *April 1978*

*Attest:*

RUTH C. MASON
*Attesting Officer*

LUTRELLE F. PARKER
*Acting Commissioner of Patents and Trademarks*